United States Patent [19]

Heger et al.

[11] 4,041,192

[45] Aug. 9, 1977

[54] METHOD OF ENHANCING HIGH POLYMERS, PARTICULARLY TEXTILES

[75] Inventors: Adolf Heger; Helmar Pässler; Frank Bennemann, all of Dresden, Germany

[73] Assignee: VEB Textilkombinat, Cottbus, Germany

[21] Appl. No.: 568,245

[22] Filed: Apr. 15, 1975

[51] Int. Cl.[2] ..... B05D 3/06

[52] U.S. Cl. ..... 427/43; 427/44; 427/262; 427/280; 427/282; 427/288

[58] Field of Search ..... 427/43, 44, 271, 272, 427/275, 276, 280, 282, 288, 261, 262, 264, 265, 267

[56] References Cited

U.S. PATENT DOCUMENTS

| | | | |
|---|---|---|---|
| 2,907,675 | 10/1959 | Gaylord | 427/44 |
| 3,088,791 | 5/1963 | Cline et al. | 427/44 |

*Primary Examiner*—John H. Newsome
*Attorney, Agent, or Firm*—Michael J. Striker

[57] ABSTRACT

A method of enhancing the properties and appearance of polymeric substances is disclosed. The method involves treating a polymer so as to effect graft polymerization over the entire surface thereof in such a manner that variations in graft density occur across the surface of the polymer. This may be accomplished by forming chemically active species, e.g., ions or free radicals, in the polymer which vary in concentration across the surface of the latter and at least once contacting the surface of the polymer with a substance, for instance, a monomer such as a vinyl compound, which undergoes a graft polymerization reaction with the chemically active species. The chemically active species may be formed by irradiating the surface of the polymer with high energy radiation, for example, a beam of electrons. Different possibilities exist for achieving a varying concentration of the chemically active species across the surface of the polymer. One possibility resides in subjecting the surface of the polymer to both a homogeneous and a non-homogeneous irradiation. Another possibility resides in subjecting the surface of the polymer to a homogeneous irradiation and then eliminating at least some of the chemically active species in selected regions of the surface of the polymer. Still another possibility resides in directing a radiation beam at the surface of the polymer and varying the direction and/or the intensity of the beam. Numerous permutations within this framework exist.

43 Claims, 15 Drawing Figures

METHOD OF ENHANCING HIGH POLYMERS, PARTICULARLY TEXTILES

BACKGROUND OF THE INVENTION

The invention relates generally to improvement of the characteristics of polymers.

It is known to change the properties of high polymers by grafting monomeric substances onto the same. The grafting of the monomeric substances may be accomplished using radiation-chemical techniques. Thus, it is possible to initially irradiate the high polymer with ionizing radiation, for instance, with electron beams generated by a Van de Graaff generator, and to subsequently bring the high polymer into contact with a monomeric substance, which latter may be in the form of a liquid. This procedure is the so-called "pre-irradiation" method. The radiation used for irradiating the high polymer is referred to as ionizing radiation since it causes ions or radicals to be formed in the high polymer. It is also possible to first contact the high polymer with a monomeric substance, which later then penetrates into the high polymer, and to thereafter irradiate the high polymer, which has been thus "loaded" with the monomeric substance, with ionizing radiation. The latter procedure is the so-called "simultaneous" method. In the latter method, there often occurs, in addition to the desired grafting reaction, an undesired homopolymerization of the monomeric substance.

Depending upon the monomer selected for grafting, different modifications of the properties of the high polymer may be obtained.

To illustrate the effects which occur, consider, for instance, a textile web composed of polyamide fibers and having the following structure:

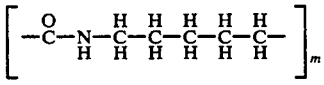

If the web is subjected to the effects of ionizing radiation, favorably irradiation with electrons, then there are primarily formed macro-radicals such as, for example, the following:

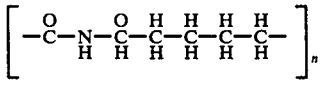

These macro-radicals are capable of causing the polymerization of a monomeric substance such as, for example, acrylamide ($CH=CHCONH_2$). The monomeric substance grafts onto the high polymer as a side chain and, if the high polymer is represented by - A - A - A - A - A - and the monomeric substance is represented by B, the effects which occur may be represented schematically as follows:

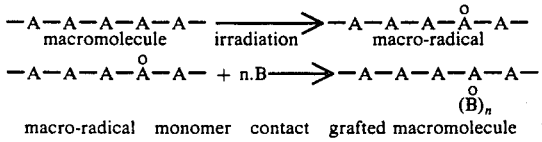

If a fabric composed of polyamide fibers is used as the high polymer and acrylamide is used as the monomeric substance, then one obtains a fabric of polyamide fibers which is characterized by exhibiting an increased capability for taking up moisture, that is, characterized by better physiological properties when used as a garment. On the other hand, when a textile web composed of polyester fibers is utilized as the high polymer and acrylic acid ($CH_2=CHCOOH$) is utilized as the monomeric substance, then there is obtained a textile web which can be colored using basic dyes. These two examples illustrate some of the modifications in properties which are achievable by grafting a monomeric substance to a high polymer. The methods outlined above provide a homogeneous or uniform modification of the properties of high polymers.

The types of radiation which may be used to obtain the radiation-chemical initiated grafting reaction include all those which are able to cause ionization or the formation of radicals. Of particular applicability here are electron beams, gamma rays and x-rays.

A disadvantage associated with the knwon methods for grafting monomeric substances onto high polymers and, in particular, onto textile webs, resides in that the textile character, that is, the appearance, of the web is not changed.

Another process is known wherein the shrinkage, that is, the decrease in size, of the web which occurs as a result of grafting is put to use for the purpose of obtaining structural or textural effects in the web. In other words, the shrinkage which occurs is used to achieve volumetric distortions of the web. Here, the free radicals requried for effecting graft polymerization are not produced homogeneously or uniformly over the entire surface of the web as in the methods discussed above but, rather, are produced in localized regions of the web. It is possible, for the purpose of local production of the radicals, to use templates which are interposed between the radiation source and the web so that radicals are produced only in locations of the web which correspond to the apertures in the templates, that is, only in locations of the web which can be reached by the radiation. On the other hand, it is also possible to homogeneously or uniformly irradiate the web with ionizing radiation and to subsequently locally destroy the free radicals in selected regions of the surface of the web. The localized destruction of the free radicals may, for instance, be carried out using heated, profiled rollers about which the irradiated web is conveyed.

When a web whih contains free radicals in localized regions thereof is contacted with a monomeric substance, shrinkage occurs locally in these regions by virtue of the grafting reaction and the localized shrinkage results in volumetric distortions of the web. The volumetric distortions of the web lead to structural effects, that is, to ornamental patterns, which latter may be combined with color patterns. Moreover, the moisture sorption characteristics of the web may be enhanced.

The latter method, which results in a so-called partial modification, has a very disadvantageous aspect associated with it. This resides in that it is not possible to achieve those effects which require a homogeneous or uniform grafting of the monomeric substance. Examples of such effects include the obtention of good anti-static properties, which require the presence of a continuous and conductive "film" and the obtention of hydrophobic properties, which require the presence of a continuous and hydrophobic "film".

SUMMARY OF THE INVENTION

It is, accordingly, a general object of the invention to provide a novel method for enhancing the characteristics of polymeric substances which enables the disadvantages outlined above to be overcome.

Another object of the invention is to provide a method which enables the appearance of polymeric substances to be enhanced while permitting a greater improvement in properties to be achieved than was possible heretofore.

A further object of the invention is to provide a method for the enhancement of polymeric webs and, advantageously, textile webs, whereby the webs may be so modified that the textile characteristics may be improved physiologically while, at the same time, improvements relating to patterning may be realized.

An additional object of the invention is to make it possible, particularly for textile webs, to improve the dye affinity, the moisture sorption characteristics, the resistance to decay, the hydrophobic characteristics and the anti-static properties while, simultaneously, obtaining ornamental structural and color patterning effects.

The foregoing objects, and others which will become apparent, are achieved in accordance with the invention. According to one aspect of the invention, there is provided a method of enhancing the properties and appearance of polymeric substances, particularly textiles, wherein a surface portion of a polymer is treated so as to effect graft polymerization over substantially the entire extent of the surface portion in such a manner that variations in graft density, i.e. number of grafts per unit area, occur across the surface portion. Thus, the properties of the surface portion are enhanced due to graft polymerization over substantially the entire extent thereof and a textured appearance is imparted to the surface portion due to the variations in graft density across the surface portion.

The treating step may include forming chemically active species, e.g., ions or free radicals, in varying concentration across the surface portion or surface of the polymeric substance or polymer and at least once contacting the surface with a substance which undergoes a graft polymerization reaction with the chemically active species. As an example, the polymer may be high polymer and the substance which undergoes a graft polymerization reaction with the chemically active species formed in the high polymer may be a monomer.

The step of forming the chemically active species may include an operation of substantially homogeneously or uniformly irradiating the surface of the polymer and an operation of irradiating only localized regions of the surface.

According to one embodiment of the invention, the surface of the polymer may be irradiated by directing a beam of radiation homogeneously or uniformly over the surface and at least partially shielding selected regions of the surface from the radiation beam. The shielding of selected regions from the radiation beam may involve interposing at least one perforate member, e.g., a template or the like, between the radiation source and the surface of the polymer. Here, the perforate member may have a thickness which exceeds the maximum distance which the radiation can penetrate into the member and, in such an event, only those regions of the polymer surface located in back of the perforations will receive a dose of the radiation. On the other hand, it is also possible for the perforate member to have a thickness less than the maximum distance which can be penetrated by the radiation and, in such an event, all regions of the polymer surface will be irradiated to at least some extent, although the regions in back of the solid portions of the perforate member will not be irradiated as strongly as those regions located in back of the perforations.

Another embodiment of the invention contemplates irradiating the polymer surface and eliminating at least some of the chemically active species at selected regions of the polymer surface. One possibility for eliminating at least some of the chemically active species is to heat the selected regions of the polymer surface. The heating may be carried out in such a manner that only some of the chemically active species are eliminated at the selected regions of the polymer surface or, on the other hand, may be carried out in such a manner that substantially all of the chemically active species are eliminated at the selected regions. It is possible to heat selected regions of the polymer surface by contacting the latter with a heated, profiled, rotating member, that is, a heated rotating member which is provided with spaced projections so that only certain regions of the polymer surface come into contact with the member. Another possibility for eliminating chemically active species resides in subjecting selected regions of the polymer surface to the action of a controlled laser beam.

The operation of forming chemically active species in the polymer may also involve directing a beam of radiation at the polymer surface and varying the intensity of the beam. Instead of this, a beam of radiation may be directed at the polymer surface and the direction of the beam controlled so that different regions are irradiated for different periods of time or so that only localized regions of the surface are irradiated. In the latter case, it is possible to additionally vary the intensity of the beam.

According to the invention, it is advantageous to irradiate the polymer surface with electrons in order to produce chemically active species. It is preferred here for electron energies between about 40 KeV and 3 MeV to be used. Although a preferred embodiment of the invention contemplates the use of electrons, it is nevertheless possible to use any type of radiation which is capable of producing chemically active species, e.g., ions or free radicals, in the polymer. Representative of types of radiation which may be used instead of or in addition to electron beams are gamma rays, beta rays and x-rays.

The operation of contacting the polymer surface with the substance to be grafted thereover may involve contacting the polymer surface with a liquid medium, e.g., a solution, which includes the substance to be grafted over the polymer surface. It is further possible to contact the polymer surface with a gaseous medium which includes the substance to be grafted over the polymer surface.

According to one embodiment of the invention, the step of contacting the polymer surface with the substance to be grafted thereover is carried out only once so that graft polymerization over substantially the entire extent of the polymer surface is obtained substantially simultaneously with variations in graft density across the polymer surface. Another embodiment of the invention contemplates contacting the polymer surface with a substance to be grafted thereover at least twice.

As indicated previously, the substance to be grafted over the polymer surface may comprise a monomer. In accordance with the invention the monomers which are particularly well-suited for use are the vinyl compounds and, as representative of the latter, there may be mentioned acrylic acid, acrylamide and styrene.

It is of advantage to contact the polymer surface with hot water, hot air and/or steam since this may serve to further enhance the characteristics thereof. This operation may be carried out any time from immediately before the treatment of the polymer surface in accordance with the invention is begun to immediately after the treatment according to the invention has been completed.

It may also be desirable to subject the polymer and, concomitantly, the polymer surface, to a predetermined tension during at least part of the treatment in accordance with the invention. For instance, this might be desirable when it is contemplated to temporarily prevent the shrinkage, which tends to occur as a result of the graft polymerization, from occurring.

The treatment according to the invention may, according to a further embodiment, include the operation of grafting a substance over the polymer surface substantially homogeneously or uniformly and may then also include the operation of grafting a substance over localized regions of the polymer surface only. Here, the substantially homogeneous grafting may be carried out prior to the localized grafting or, on the other hand, the substantially homogeneous grafting may be carried out subsequent to the localized grafting. It is possible for the substance which is substantially homogeneously grafted over the polymer surface to be the same as that which is grafted over the localized regions of the latter or for the substance which is substantially homogeneously grafted over the polymer surface to be different from that which is grafted over the localized regions of the polymer surface. If necessary or desirable, the polymer surface may be rinsed or washed between the substantially homogeneous grafting operation and the localized grafting operation. In such an event, it is further possible to dry the polymer surface subsequent to the rinsing step and before proceeding to the subsequent grafting operation.

The substantially homogeneous grafting operation may involve substantially homogeneously or uniformly irradiating the polymer surface so as to cause the formation of chemically active species, and substantially homogeneously contacting the polymer surface with a substance which undergoes a graft polymerization reaction with the chemically active species. The substance which undergoes the graft polymerization reaction with the chemically active species may, as before, comprise a monomer and, advantageously, a vinyl compound. Several possibilities exist as regards the irradiating step and the step of contacting the polymer surface with the substance to undergo the graft polymerization reaction. Thus, the irradiating step may, at least in part, be carried out prior to the contacting step. It is also possible to at least partially carry out the irradiating step during the contacting step. A further possibility resides in carrying out the irradiating step subsequent to the contacting step, at least in part.

According to one embodiment of the invention, the localized grafting operation may involve irradiating only localized regions of the polymer surface so as to cause the formation of chemically active species, and substantially homogeneously contacting the polymer surface with a substance which undergoes a graft polymerizaton reaction with the chemically active species. The substance which undergoes the graft polymerization reaction with the chemically active species may again comprise a monomer and, favorably, a vinyl compound. Here, also, various possibilities as above exit with respect to the other in which the irradiating and contacting steps are performed. The localized irradiation may be effected by directing a beam of radiation at the polymer surface and shielding the regions of the latter other than the localized regions which are to be irradiated from the radiation. The shielding operation may, for example, be carried out in the manner described earlier, that is, by interposing one of more perforate members between the polymer surface and the radiation source. Of course, if it is desired for the shielded regions of the polymer surface to receive no radiation dose whatsoever, the thickness of the perforate member or members should exceed the maximum distance which the radiation can penetrate. The localized irradiation may also be effected by directing a radiation beam at the polymer surface and varying the intensity of the beam, it being understood that, if certain regions of the polymer surface are to receive no radiation dose whatsoever, the direction of the radiation beam should also be controlled so as not to be directed to these regions. It is further possible to direct a radiation beam at the polymer surface and to simply control the direction of the beam without varying the intensity, it again being understood that, where certain regions are to receive no radiation dose, the radiation beam should not be directed to these regions.

In accordance with yet another embodiment of the invention, the localized grafting operation may involve substantially homogeneously irradiating the polymer surface so as to cause the formation of chemically active species, eliminating the chemically active species in the regions of the polymer surface other than those where localized grafting is to occur, and substantially homogeneously contacting the polymer surface with a substance which undergoes a graft polymerization reaction with the chemically active species. The substance which is to undergo a graft polymerization reaction with the chemically active species may here also comprise a monomer and, advantageously, a vinyl compound. The step of eliminating the chemically active species may be effected by heating those regions of the polymer surface where grafting is not desired, it being understood that, whee grafting is to be localized in the sense that no grafting occurs at certain regions, the chemically active species in the latter should be substantially completely eliminated. The heating operation may, for example, be carried out by contacting the polymer surface with a heated, profiled, rotating member as discussed previously. It is further possible to effect the eliminating step by subjecting the regions of the polymer surface where elimination is desired to the action of a controlled laser beam.

It may be mentioned that either one or both of the grafting operations, i.e., the substantially homogeneous grafting operation and the localized grafting operation, may involve contacting the polymer surface with a liquid medium, e.g., a solution, which includes the substance to undergo a graft polymerization reaction. On the other hand, either one or both of these grafting operations may involve contacting the polymer surface with a gaseous medium which includes the substance to undergo a graft polymerization reaction. It may be desirable for the polymer and, concomitantly, the polymer surface, to be subjected to a predetermined tensile stress during at least part of one or both grafting operations.

It is also to be noted that substantially homogeneous irradiation used for the substantially homogeneous grafting operation, as well as irradiation used for the localized grafting operation, may be carried out with any type of radiation which is capable of forming chemically active species, e.g., ions or free radicals, in the polymer. However the use of electron beams is again preferred and, advantageously, the electrons have energies between about 40 KeV and 3 MeV.

A further embodiment of the invention resides in that a polymer, particularly a web, is substantially homogeneously irradiated by means of ionizing radiation and either before, during or after the substantially homogeneous irradiation is substantially homogeneously contacted with a monomeric substance. If necessary, the web is then subjected to an intermediate rinse and an intermediate drying operation. Subsequently, the web is locally irradiated with ionizing radiation and substantially homogeneously contacted with a monomeric substance or, on the other hand, the web is subsequently substantially homogeneously irradiated with ionizing radiation, locally contacted with an agent or agents which destroy the radicals formed and substantially homogeneously contacted with a monomeric substance.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
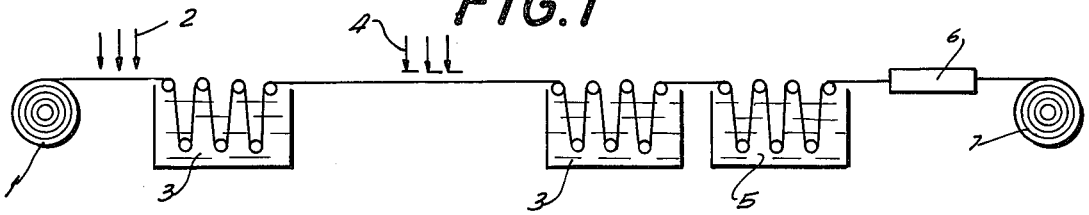
FIGS. 1–15 are schematic representations of various arrangements in accordance with the invention which may be used for carrying out different embodiments of the method according to the invention.

The invention is generally concerned with the enhancement of the properties and appearance of polymeric substances. Of particular interest to the invention are the enhancement of the properties and appearance of high polymers.

In a preferred aspect, the invention relates to a method for the enhancement or improvement of polymeric substances which are irradiated by means of ionizing radiation and subjected to a grafting reaction whereby, advantageously, the dye affinity, the moisture sorption characteristics, the anti-static properties, the dirt repellant characteristics, the resistance to decay and/or the hydrophobic properties are changed positively and, simultaneously, structural or textural effects and color patterning effects are obtained. These ends are achieved in accordance with the invention.

The term "ionizing radiation" refers to radiation of the type which is capable of causing the formation of chemically active species such as, for instance, ions or radicals, in a polymer.

A particular concern of the invention is with a method for the enhancement or improvement of webs, especially textile webs.

As indicated previously, one aspect of the invention resides in a method of enhancing the properties and appearnace of polymeric substance which comprises treating a surface of a polymer so as to effect graft polymerization over substantially the entire extent of the surface in such a manner that variations in graft density occur across the polymer surface. The graft density refers to the number of grafts formed per unit of area. In this manner, the properties of the treated portion of the polymer are enhanced by virtue of the fact that graft polymerization occurs over substantially the entire extent thereof while, at the same time, a textured appearance may be imparted to the treated portion of the polymer by virtue of the fact that variations in graft density occur. The graft polymerization causes shrinkage of the polymer and the variations in graft density result in variations of the degree of shrinkage.

Numerous embodiments of the method of the invention are contemplated. A few of these will now be described with reference to the drawing.

In the FIGURES, the reference numeral 1 indicates a web which is to be subjected to a treatment in accordance with the invention. It is assumed here that the web 1 is constituted by a high polymer. The reference numeral 2 identifies a field or beam of ionizing radiation which is used to homogeneously irradiate the web 1. The reference numeral 3 indicates a zone through which the web 1 passes and wherein the latter is contacted with a substance to be grafted thereto. The substance to be grafted over the web 1 is here assumed to be a monomeric substance. In the illustrated embodiments, the monomeric substance is in a solution through which the web 1 is conveyed. The reference numeral 4 identifies a field or beam of ionizing radiation which is used to either inhomogeneously or locally irradiate the web 1. The reference numeral 5 indicates a rinsing and/or washing zone through which the web 1 is passed and wherein it is contacted with a rinsing and/or washing bath. The reference numeral 6 identifies a drying zone through which the rinsed and/or washed web 1 is passed to be dried. The reference numeral 7 indicates the treated web having enhanced properties and appearance. The reference numeral 8 identifies an arrangement for eliminating chemically active species formed by irradiation. In the illustrated embodiment, the arrangement 8 is shown as being in the form of a rotating, heated member provided with a plurality of spaced projections. The member 8 eliminates chemically active species only in certain regions of the web 1. However, it is to be understood that the member 8 is representative of other arrangements which may be used to eliminate chemically active species in the web 1. An example of such other arrangements is a controlled laser beam. It may be mentioned that a controlled laser beam is more versatile than the member 8 shown in that a controlled laser beam could be directed to all regions of the web 1 thereby making it possible, for instance, to eliminate some of the chemically active species in certain regions of the web 1 and to eliminate substantially all of the chemically active species in other regions of the web 1. It may be further mentioned that the member 8 may be heated sufficiently to eliminate substantially all of the chemically active species in the regions of the web 1 contacted thereby or, on the other hand, may be heated only to such an extent that only some of the chemically active species in the regions of the web 1 contacted thereby are eliminated.

Various embodiments of the method according to the invention will now be discussed with reference to the FIGURES.

1. FIG. 1.

The web 1 is subjected to a homogeneous modification in accordance with the pre-irradiation method. For this purpose, the web 1 is first irradiated with ionizing radiation in the homogeneous radiation field 2. As a result of the irradiation, chemically active species, e.g., ions or radicals, are produced in the web 1. The web 1 is then contacted with the grafting solution in the zone 3. In the grafting solution, graft polymerization of the monomeric substance in the solution over the web 1 is initiated by the chemically active species. Subsequent to passing through the zone 3, the web 1 may, if desired or necessary, be subjected to an intermediate rinsing operation and an intermediate drying operation. This has not been illustrated for the sake of clarity. After the rinsing and drying operations or, where these operations are omitted, after leaving the zone 3, the web 1 is subjected to ionizing radiation in the inhomogeneous radiation field 4. The inhomogeneous radiation field 4 may, for instance, be due to interposition of one or more perforate members such as, for example, templates, between the web 1 and the radiation source or, on the other hand, may be a result of varying the intensity of and/or controlling the direction of the radiation beam. Due to the inhomogeneous irradiation, chemically active species are produced in the web 1 locally and/or in different concentration at different regions of the web 1. Subsequent to the inhomogeneous irradiation, the web 1 is passed through a second zone 3 wherein it is again contacted with a solution of a monomeric substance. In the grafting solution, the chemically active species produced by virtue of the inhomogeneous irradiation cause grafting of the monomeric substance over the web 1 locally and/or with different graft density at different regions of the web 1. The grafting here brings with it either localized shrinkage of the web 1 and/or different degrees of shrinkage at different regions of the web 1. This, in turn, results in the production of an ornamental structural or textural effect. After passing through the second zone 3, the web 1 passes through the zone 5 wherein it is rinsed and through the zone 6 wherein it is dried. Thereafter, the enhanced web may be wound up as indicated at 7 or may be folded in suitable manner.

2. FIGURE 2.

Figure 2:
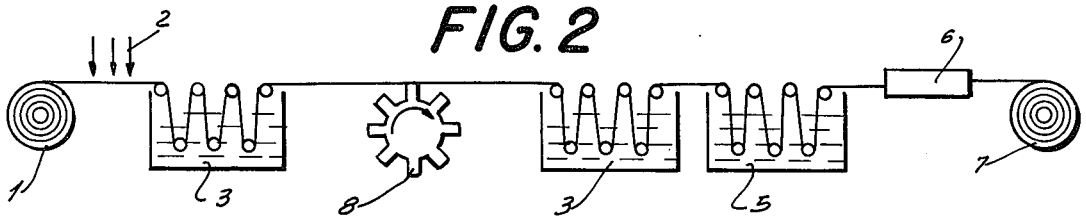

The web 1 is subjected to a homogeneous modification and, for this purpose, the same procedure as described with reference to FIG. 1 is used. In the embodiment of FIG. 2, however, the web 1 is not subjected to inhomogeneous irradiation after the homogeneous grafting operation. Rather, subsequent to the homogeneous grafting operation, the chemically active species, e.g., free radicals, still remaining in the web 1 are at least partially eliminated in at least some regions of the latter. Of course, the radiation dose and/or the extent to which grafting occurs during the homogeneous modification should be such that chemically active species are still present in the web 1 subsequent to the homogeneous modification. The elimination of the chemically active species may, for instance, be carried out with a hot, profiled roller such as the member 8 illustrated or by means of a laser beam or laser beams. After elimination of the chemically active species, the web 1 enters a zone 3 wherein it is contacted with a solution of a monomeric substance. In the grafting solution, the chemically active species still present locally and/or in varying concentration in the web 1 initiate grafting of the monomeric substance locally and/or with different graft density over the web 1. The grafting causes localized shrinkage and/or shrinkage of varying degree in the web 1 which, in turn, results in the formation of an ornamental structure or texture. Subsequent to leaving the zone 3, the web 1 may, as before, be rinsed, dried and wound up or folded.

3. FIG. 3.

The procedure here is similar to that described with reference to FIG. 2. However, in the embodiment of FIG. 3, the web 1 is subjected to an additional irradiation with ionizing radiation between the homogeneous grafting operation and the operation of eliminating chemically active species. This additional irradiation is carried out in a second homogeneous radiation field 2 and serves to enhance the subsequent partial grafting and/or grafting with different graft density which occurs over the web 1.

4. FIG. 4.

The web 1 is homogeneously modified according to the simultaneous method. To this end, the web 1 is contacted with a grafting solution containing a monomeric substance in a first zone 3 so as to become impregnated with the monomeric substance and thereafter subjected to the action of the homogeneous radiation field 2. Subsequest to this homogeneous modificaion, the web 1 is subjected to ionizing radiation in the inhomogeneous radiation field 4 and conveyed to a second zone 3 wherein it is again contacted with a grafting solution. In the latter solution, a localized grafting and/or a grafting with varying graft density occurs over the web 1. By virtue of this grafting, localized and/or varying degrees of shrinkage occur which lead to the formation of an ornamental structure or texture for the web 1. After leaving the second zone 3, the web 1 may, as previously, be rinsed, dried and wound up or folded in suitable manner.

5. FIG. 5.

The web 1 is first homogeneously modified according to the simultaneous method in the manner described with reference to FIG. 4. In the embodiment of FIG. 5, however, the web 1 is not subjected to the action of an inhomogeneous radiation field after being irradiated with ionizing radiation in the homogeneous radiation field 2. Rather, the chemically active species, e.g., free radicals, remaining in the web 1 subsequent to the homogeneous modification are at least partially eliminated in at least some regions thereof. This may, for instance, again be effected by means of heated, profiled rollers such as the member 8 illustrated or by means of a laser beam or laser beams. In this manner, the chemically active species are localized to certain regions of the web 1 and/or are present in varying concentration in different regions of the latter. After elimination of chemically active species, the web 1 is passed into a zone 3 wherein it is contacted with a grafting solution which contains a monomeric substance. By virtue of elimination of chemically active species, a localized grafting and/or a grafting with varying graft density of the monomeric substance is obtained, this being accompanied by localized shrinkage and/or shrinkage of varying degree and the production of an ornamental structure or texture. Subsequent to leaving the zone 3, the web 1 may be rinsed, dried and wound up or folded. It will again be understood that the radiation dose and/or the extent to which grafting occurs during the homogeneous modification should be such that chemically active species are still present in the web 1 after the homogeneous modification.

6. FIG. 6.

The web 1 is here first subjected to a partial modification. For this purpose, the web 1 is conveyed into the inhomogeneous radiation field 4 where it is irradiated with ionizing radiation locally and/or with varying intensity. Advantageously, the inhomogeneous radiation field 4 is produced with the aid of one or more perforate members such as, for instance, templates, interposed between the web 1 and the radiation source or, on the other hand, by variation of the intenstiy of and/or control of the direction of the radiation beam. Subsequent to the inhomogeneous irradiation, the web 1 passes into a first zone 3 accommodating a grafting solution which contains a monomeric substance and wherein a localized grafting of the monomeric substance and/or a grafting with varying graft density occurs. Concomitantly, localized shrinkage and/or shrinkage of varying degree occurs in the web 1 which leads to the formation of an ornamental structure or texture. After passing through the zone 3, the web 1 is homogeneously modified in accordance with the pre-irradiation method by irradiating it with ionizing radiation in the homogeneous radiation field 2 and then conveying it into a second zone 3 where it is treated with a grafting solution. Thereafter, the web 1 may be rinsed or washed, dried and wound up or folded.

7. FIG. 7.

The procedure followed here is similar to that described with reference to FIG. 6. However, in the embodiment of FIG. 7, the web 1 is not again contacted with a grafting solution subsequent to being homogeneously irradiated. Rather, after the irradiation in the homogeneous radiation field 2, the web 1 is conveyed directly into the rinsing or washing zone 5. It will be understood that the radiation dose and/or the extent to which grafting occurs during the partial modification should be such that the web 1 still retains a quantity of the monomeric substance after the partial modification which may be used for grafting.

8. FIG. 8.

Figure 6:
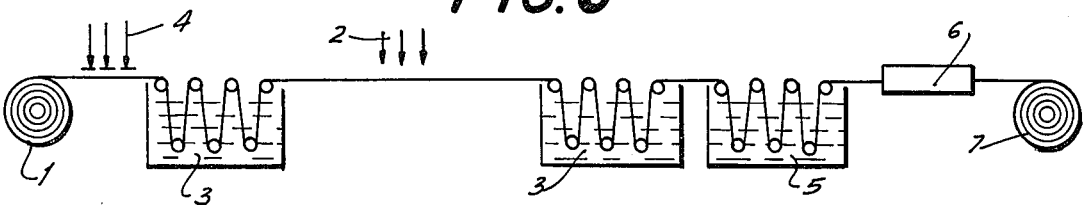
Figure 7:
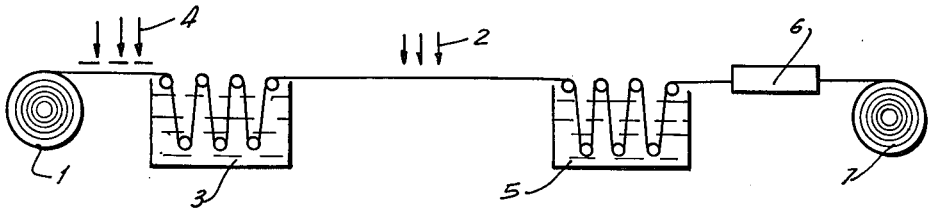

Here, the web 1 is subjected to a partial modification using the procedure outlined with reference to FIG. 6. Similarly to the embodiment of FIG. 6, the web 1 is subsequently subjected to a homogeneous modification. However, in contrast to the embodiment of FIG. 6, the homogeneous modification is, in the present instance, carried out in accordance with the simultaneous method by conveying the web 1 into a second zone 3 subsequent to the partial modification and wherein it is treated with a grafting solution. After leaving the second zone 3, the web 1 is irradiated with ionizing radiation in the homogeneous radiation field 2. The web 1 may then be rinsed and/or washed, dried and wound up or folded.

9. FIG. 9.

The web 1 is here also first partially modified. In the present case, this is accomplished by iradiating the web 1 with ionizing radiation in a first homogeneous radiation field 2 and thereafter eliminating at least some of the chemically active species, e.g., radicals, thus formed in at least some regions of the web 1 utilizing the arrangement 8 provided for this purpose. In this manner, the chemically active species may be localized to certain regions of the web 1 and/or varying concentrations of the chemically active species may be obtained. After passing by the arrangement 8, the web 1 is conveyed into a first zone 3 wherein it is contacted with a grafting solution which contains a monomeric substance, this resulting in localized grafting of the monomeric substance and/or in grafting of the monomeric substance with varying graft density. By virtue of the grafting, an ornamental structure or texture is obtained. After leaving the first zone 3, the web 1 is subjected to a homogeneous modification according to the pre-irradiation method. Thus, the web 1 is irradiated with ionizing radiation in a second homogeneous radiation field 2 and thereafter conveyed into a second zone 3 wherein it is again contacted with a grafting solution. Subsequently, the web 1 is rinsed and/or washed, dried and would up or folded in suitable manner.

10. FIG. 10.

Figure 9:
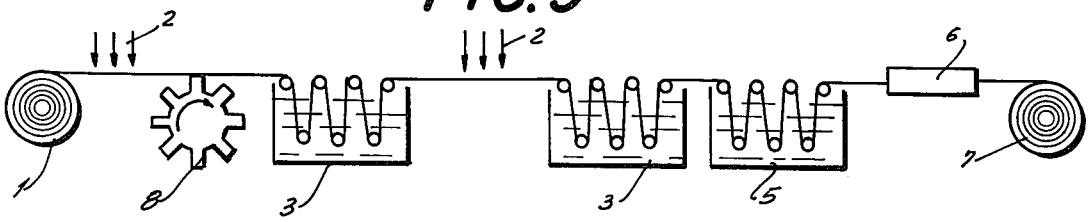
Figure 10:
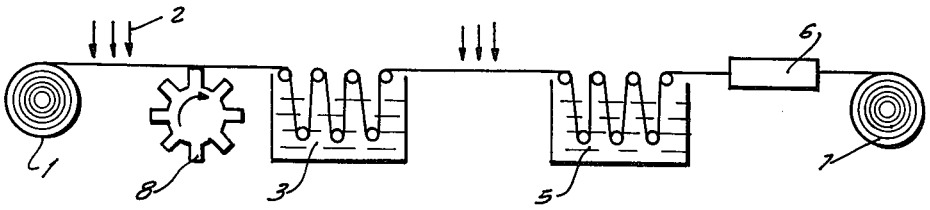

The procedure used here is similar to that described with reference to FIG. 9. In the embodiment of FIG. 10, however, the treatment of the web 1 with a grafting solution subsequent to irradiation in the second homogeneous radiation fields 2 is omitted, that is, the second zone 3 of FIG. 9 is omitted. It will again be understood that the radiation dose and/or the extent to which grafting occurs during the partial modification should be such that the web 1 still retains a quantity of the monomeric substance after the partial modification which may be used for grafting.

11. FIG. 11.

In this case, the web 1 is also partially modified initially in the manner outlined with reference to FIG. 9. Moreover, similarly to the embodiment of FIG. 9, the web 1 is homogeneously modified subsequent to the partial modification. In contrast to the embodiment of FIG. 9, however, the homogeneous modification is here carried out in accordance with the simultaneous method. Thus, after leaving the first zone 3, the web 1 is directly conveyed into the second zone 3 wherein it is again treated with a grafting solution. Thereafter, the web 1 is subjected to ionizing radiation in the second homogeneous radiation field 2. Subsequently, the web 1 is rinsed and/or washed, dried and wound up or folded.

12. FIG. 12.

The procedure used here is the same as that utilized for the embodiment of FIG. 10. The embodiment of FIG. 12, however, illustrates that the irradiation of the web 1 for the purpose of effecting a homogeneous modification may be carried out in one and the same irradiating arrangement, e.g., an electron accelerator, as is used in the irradiation of the web 1 for the purpose of effecting a partial modification. Thus, the two homogeneous radiation fields 2 shown are produced by the same irradiating arrangement and the path of the web 1 is such that it returns to the irradiating arangement after leaving the zone 3.

13. FIG. 13.

The web 1 is homogeneously irradiated in a first radiation fields 2 and thereafter conveyed into a first zone 3 wherein it is contacted with a grafting solution. Subsequent to this homogeneous modification that is, after leaving the zone 3, the chemically active species, e.g., radicals, still present are at least partially eliminated in at least some regions of the web 1 using the arrangement 8 provided for this purpose which may, for instance, be in the form of a heated, profiled roller. In this manner, the chemically active species are confined to certain regions of the web 1 and/or a varying concentration of the chemically active species is obtained. After passing by the arrangement 8, the web 1 enters a second zone 3 wherein it is again contacted with a grafting solution. Subsequently, the web 1 is homogeneously irradiated once more in a second radiation field 2. Thereafter, rinsing and/or washing, drying and winding or folding may be carried out.

14. FIG. 14.

The web 1 is first irradiated homogeneously in the radiation field 2. Directly thereafter, the web 1 is partially or inhomogeneously irradiated in the radiation field 4. After passing through the radiation field 4, the web 1 enters the zone 3 wherein it is contacted with a grafting solution. The partial or inhomogeneous irradiation which follows the homogeneous irradiation causes the concentration of chemically active species in various regions of the web 1 to be different. The web 1 may be rinsed and/or washed, dried and wound or folded after leaving the zone 3.

15. FIG. 15.

The web 1 is first homogeneously irradiated in a first radiation field 2. Thereafter, at least some of the chemically active species, e.g., radicals produced by the irradiation are eliminated in at least some regions of the web 1. Thus, after leaving the radiation field 2, the web 1 passes to the arrangement 8 provided for this purpose and which may, for example, be in the form of a heated, profiled roller. The chemically active species are thus confined to localized regions of the web 1 and/or a varying concentration of the chemically active species is obtained. Subsequent to elimination of chemically active species, the web 1 is homogeneously irradiated once more in a second radiation field 2 and then conveyed into the zone 3 wherein it is contacted with a grafting solution. This may be followed by rinsing and/or washing, drying and winding or folding.

The monomeric substance may be present in liquid or gaseous phase for the homogeneous modification, as well as for the partial modification.

It may be mentioned that known treatments such as washing, rinsing and drying may be interposed between the individual stages of the method according to the invention in any desired sequence. It is also noted that the grafting carried out for the purpose of achieving a partial modification may be performed either without subjecting the polymer being treated to stress or by subjecting the polymer to a predetermined stress. Particular attention in this connection has been directed to the grafting carried out for the purpose of achieving a partial modification since it is here that shrinkage of varying degree can occur. Thus, it is sometimes desirable to delay the shrinkage of varying degree temporarily and this is one reason why a predetermined stress might be applied to the polymer being treated. If it is desired to delay the homogeneous shrinkage which accompanies a homogeneous grafting, then the grafting carried out for the purpose of achieving a homogeneous modification could also be performed by subjecting the polymer to a predetermined stress.

With respect to the inhomogeneous irradiation, it will be understood that the shielding used for this purpose, and also the control of the direction and/or the variation in the intensity of the radiation beam used for this purpose, are intended to result in different radiation doses for different regions of the polymer being treated. With respect to the elimination of chemically active species, it may be noted that the extent to which these are eliminated may be controlled by regulating the time for which the eliminating operation is carried out and/or by regulating the intensity of the eliminating treatment. For instance, where a heated member is used in the eliminating operation, the temperature of the member and/or the time for which the member is contacted with a given region may be regulated to control the extent to which the chemically active species in this region are eliminated. Where a laser beam is used in the eliminating treatment, on the other hand, the intensity of the laser beam and/or the time for which this is directed to a given region may be regulated to control the extent to which the chemically active species in this region are eliminated.

It may be further mentioned here that, in accordance with the invention, the partial modification effect and, in particular, the ornamental structure or texture of the polymer or web, may be enhanced by treating the polymer or web with hot water, steam and/or hot air.

A discussion of the details of devices which may be used for the irradiation is omitted in this description since devices for generating the high energy radiation used as ionizing radiation are well-known.

It will be appreciated that, according to the invention, advantage is taken of the improvement in properties, e.g., dirt-repellant characteristics, anti-static characteristics, hydrophobic characteristics, etc., which may be realized by providing a continuous film of a substance over a surface of a polymer. On the other hand, the invention concomitantly takes advantage of the shrinkage which occurs by virtue of graft polymerization. Thus, by homogeneously grafting a substance over a surface of a polymer, that is, by providing for a uniform graft density, only homogeneous shrinkage will occur. Accordingly, the invention provides for varying graft density so as to cause relative shrinkage of different regions of a polymer which, in turn, leads to structural or textural effects.

All natural and synthetic high polymers may be treated in accordance with the method of the invention. Representative polymers include polyamides, polyesters, polyolefins, cellulose and polyacrylonitrile. More specific but non-limiting examples of polymers include polyamide-6, polyamide-6.6, polyethyleneterephthalate, polyethylene, polypropylene, PAN-homopolymer and PAN-copolymers (PAN being an abbreviation for polyacrylonitrile).

Below are listed ranges of radiation doses which may be absorbed by different polymers due to irradiation. The listed polymers and radiation doses are intended as a guide only and are not to be construed as limiting the invention. The following are presented as exemplary: (a) polyamides, $5.10^5-10^7$ rad; (b) polyesters, $10^6-5.10^7$ rad; (c) polyolefins, $10^6-5.10^7$ rad; and (d) polyacrylonitrile, $5.10^5-10^7$ rad.

Irradiation is generally carried out at temperatures between about 20° and 100° C.

Substances which may be grafted over a polymer surface comprise monomers as indicated previously. Monomers which may be considered as representative are acrylamide, acrylic acid, styrene, acrylonitrile, itaconic acid, divinylbenzene, triallylcyanurate and polyfunctional monomeric substances. As mentioned previously, vinyl compounds are preferred.

Contact between the polymer being treated and the substance to be grafted thereover is most often carried out at temperatures between 20° and 80° C. However, since the substance to be grafted to the polymer may be present in the form of a vapor, the contact temperature could exceed 80° C. Also, when the substance to be grafted over the polymer is contacted with the latter in the form of a solution, it is sometimes desirable for the solution of the substance to be at boiling temperature, which latter could exceed 80° C.

Normally, the time for which the polymer is contacted with the substance to be grafted thereover lies between approximately 1 and 30 minutes.

The following Examples, which are intended to further illustrate the invention, are not to be construed as limiting the same in any manner:

EXAMPLE 1

This Example describes a procedure which may be carried out with an arrangement such as illustrated in FIG. 1.

A flat warp knit fabric composed of polyamide silk has a mass per unit area of 100 grams per square meter and a width of 1.80 meters. The fabric is irradiated with electrons beneath the scanner of an electron accelerator of the insulating core type. The electron energy is 300 KeV and the radiation irradiated into the fabric is $4.10^6$ rad. The fabric is irradiated homogeneously and, subsequent to the irradiation, the fabric is continuously conveyed into a grafting solution in order to achieve a homogeneous grafting. The grafting solution is an aqueous 20 percent solution of acrylic acid. The temperature of the solution is 38° C and the fabric remains in the solution for a period of 10 minutes. After the homogeneous grafting of the fabric with acrylic acid, which grafting is carried out while the fabric is subjected to stress, the fabric is rinsed, washed and subjected to an intermediate drying operation. The fabric is then once more irradiated beneath the scanner of an electron accelerator.* Here, a portion of the electron radiation field is blocked from the fabric by means of perforate discs of aluminum having a thickness of 1 millimeter. As a result, the fabric is irradiated only in certain regions which are determined by the pattern defined by the aluminum discs. Subsequent to the irradiation, the fabric is conveyed into a grafting solution which is in the form of an aqueous 30 percent solution of acrylamide. The localized radicals formed during the last-mentioned irradiation initiate a local grafting in the solution. The solution has a temperature of 45° C and the duration of the grafting amounts to 15 minutes. By virtue of the localized grafting of the acrylamide, localized shrinkage occurs in the fabric which, in turn, leads to an ornamental structure. After grafting, the fabric is rinsed and subjected to a treatment with sodium (Na) ions in order to form the sodium salt of the homogeneously grafted acrylic acid. Finally, the fabric is rinsed once again and then dried. As a result of the treatment outlined, there is obtained a flat warp knit fabric of polyamide silk which is hydrophilic, very readily dyed, possesses good anti-static characteristics and is provided with ornamental structural effects. The fabric is particularly suitable as a textile web for outerwear and underwear having very good physiological characteristics as garments.

*(electron energy 300 keV, radiation irradiated into the fabric $2.10^6$ rad)

EXAMPLE 2

This Example describes a procedure which may be carried out with an arrangement such as illustrated in FIG. 2.

A polypropylene foil has a thickness of 60 micrometers and a width of 1.65 meters. The foil is irradiated with electrons beneath the scanner of an electron accelerator. The electron energy is 300 KeV and the radiation dose absorbed is $8.10^6$ rad. After the irradiation, the foil is treated in a grafting solution which is in the form of an aqueous solution containing 8 percent acrylamide and 10 percent acrylic acid. The grafting temperature is 35° C and the duration of grafting is 25 minutes. Subsequent to grafting, the foil is rinsed in order to remove residual monomers and the free radicals still present in the foil are then destroyed locally by means of a profiled, heated roller. Thereafter, the foil is treated for a period of 10 minutes in a 20 percent aqueous solution of acrylic acid which has been brought to boiling. A localized grafting of acrylic acid and localized shrinkage occur, the localized shrinkage resulting in an ornamental structure of the foil. In this manner, there is obtained a foil having good anti-static characteristics and a pile-like structure and which is readily dyed and possesses differential dyeing characteristics. The latter may be put to use for decorative purposes such as, for example, in room design.

EXAMPLE 3

Figure 3:
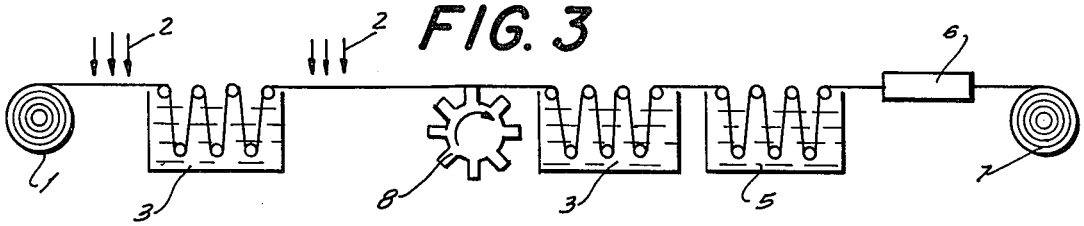

This Example describes a procedure which may be carried out with an arrangement such as illustrated in FIG. 3.

The same procedure as in Example 2 is used. However, after the homogeneous grafting in the acrylamide-acrylic acid solution, an irradiation is carried out wherein the radiation dose is $5.10^6$ rad. This improves the structural effects.

EXAMPLE 4

This Example describes a procedure which may be carried out with an arrangement such as illustrated in FIG. 3.

A knitted fabric composed of 50 percent cotton fibers and 50 percent polyamide fibers has a mass per unit area of 250 grams per square meter and a width of 1.80 meters. The fabric is irradiated with electron beams in a homogeneous field of electron beams generated by an electron accelerator which is of known construction per se. The electron energy is 450 KeV and the radiation dose absorbed is $2.10^6$ rad. Subsequently, the fabric is conveyed into an alcoholic solution of styrene which is composed of 50 percent methanol and 50 percent styrene. The solution is heated to 40° C and the fabric is retained in the solution for a period of 15 minutes. The fabric which has been grafted with styrene is thereafter irradiated once more, the radiation dose being $1.5.10^6$ rad. The free radicals formed by virtue of the second irradiation are locally destroyed due to the heat generated in the fabric by means of a controlled laser beam.* As a result, the fabric only grafts locally in a second, subsequent grafting operation. Thus, localized shrinkage and an ornamental structure are obtained. In this manner, there is obtained a knitted fabric which has been made permanently hydrophobic and which, in addition, exhibits a pleasing, voluminous character. A knitted fabric such as this is particularly well-suited for weather-resistant, outerwear textiles.

*(Grafting temperature 30° C, duration of grafting 10 minutes, alcoholic styrene solution consisting of 20 percent styrene)

EXAMPLE 5

Figure 4:
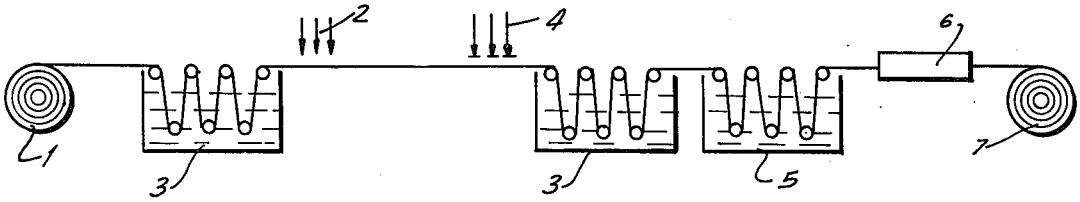
Figure 5:
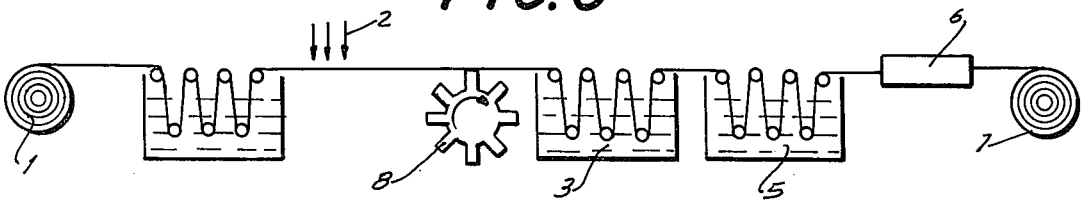

This Example describes a procedure which may be carried out with an arrangement such as illustrated in FIG. 4.

A woven fabric composed of 50 percent polyamide fibers and 50 percent polyester fibers has a mass per unit area of 220 grams per square meter and a width of 1.40 meters. The fabric is soaked in an aqueous 25 percent acrylic acid solution at a temperature of 20° C for a period of 5 minutes. Subsequently, the fabric is irradiated under the scanner of an electron accelerator with electrons having an energy of 450 KeV. The radiation dose absorbed is $2.10^6$ rad. This is followed by another irradiation* using an electron beam the direction of which is controlled. The electron beam inscribes a pattern of circular regions on the fabric, the circles having a diameter of 5 millimeters and a grid spacing of 12 millimeters. Thus, the free radicals are confined in this manner. Subsequently, the fabric is treated in an aqueous 25 percent solution of acrylic acid at a temperature of 45° C for a period of 15 minutes. Consequently, a localized grafting occurs which, by virtue of the localized shrinkage occurring concomitantly, leads to an ornamental structure of the fabric. Thereafter, rinsing and drying are carried out. There is obtained in this manner, a permanently enhanced fabric of polyamide and polyester fiber materials having improved dyeing characteristics, an improved ability to take up water and, in addition, possessing a voluminous character. Such fabrics are particularly suitable for fashionable textiles which have good physiological properties for garments.

*(radiation dose is $10^6$ rad)

EXAMPLE 6

This Example describes a procedure which may be carried out with an arrangement such as illustrated in FIG. 5.

A non-woven fleece composed of 50 percent polyacrylonitrile fiber material and 50 percent polyamide fiber material has a mass per unit area of 160 grams per square meter. The fleece is soaked with monomeric methylmethacrylate and then squeezed so that a weight increase of 80 percent is obtained. Subsequently, the fleece is irradiated in the homogeneous radiation field of an electron accelerator. The electron energy is 300 KeV and the radiation dose absorbed is $3.10^6$ rad. Consequently, the monomeric methylmethacrylate is polymerized, on the one hand, and free radicals are formed in the fleece, on the other hand. A portion of the free radicals is destroyed locally by means of a heated, profiled roller. After the localized destruction of the radicals, the fleece is treated in an alcoholic styrene solution consisting of 60 percent styrene and 40 percent methanol at a temperature of 35° C for a period of 15 minutes. As a result, a localized grafting of styrene occurs and, by virtue of the localized shrinkage which accompanies this, there is obtained a fleece having a surface texture. The fleece is characterized by good resistance to decay and acids and may, in particular, find an application as an industrial textile.

Homogeneous grafting is provded with homogeneous irradiation. The fleece is soaked with monomeric methylmethacrylate before irradiation.

EXAMPLE 7

This Example describes a procedure which may be carried out with an arrangement such as illustrated in FIG. 6.

A woven fabric composed of 60 percent polyacrylonitrile fiber material and 40 percent polyester fiber material has a mass per unit area of 140 grams per square meter and a width of 2.00 meters. With the aid of a template, the fabric is locally irradiated beneath the scanner of an electron accelerator. The electron energy is 300 KeV and the radiation dose absorbed is $5.10^6$ rad. The fabric which has been thus locally irradiated is treated for a period of 15 minutes in styrene vapor whereby a localized grafting occurs. Due to the localized grafting, localized shrinkage occurs which, during a subsequent treatment with hot air at a temperature of 120° C, is further enhanced. There is obtained a fabric which is provided with an ornamental structure. This fabric is subsequently irradiated in the homogeneous radiation field of an electron accelerator and is treated in an alcoholic 50 percent styrene solution at a temperature of 40° C for a period of 15 minutes.* After removing residual monomer, there is obtained an extremely weather-resistant fabric.

*(radiation dose is $3.10^6$ rad)

EXAMPLE 8

This Example describes a procedure which may be carried out with an arrangement such as illustrated in FIG. 6.

A fleece composed of 70 percent cotton fibers and 30 percent polypropylene fibers has a mass per unit area of 180 grams per square meter. With the aid of a template composed of aluminum of 1 millimeter thickness and which is provided with apertures arranged in a pattern, the fleece is locally irradiated under the scanner of an electron accelerator. The electron energy is 300 KeV and the absorbed radiation dose is $1.3.10^6$ rad. Immediately after the localized irradiation, there follows a 10 minute treatment in an aqueous 25 percent acrylic acid solution which is at boiling temperature. Consequently, a localized grafting of acrylic acid onto the fleece occurs. Subsequent to this treatment, the fleece is irradiated in the homogeneous radiation field of an electron accelerator until absorption of a radiation dose of $1.8.10^6$ rad and again treated for 10 minutes in an aqueous 25 percent solution of acrylic acid at boiling temperature. In this manner, there is obtained a strengthened fleece of cotton and polypropylene fibers which can be dyed in a bath and, in addition, possesses a voluminous character.

EXAMPLE 9

Figure 8:
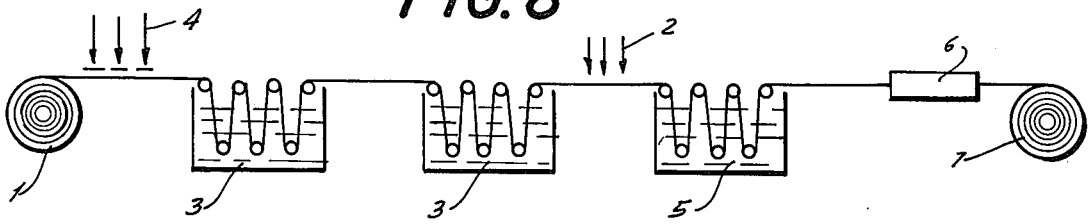

This Example describes a procedure which may be carried out with an arrangement such as illustrated in FIG. 8.

A polyamide foil having a thickness of 70 micrometers is, with the aid of a template, irradiated in the inhomogeneous radiation field of an electron accelerator. The electrons energy is 250 KeV and irradiation is continued until a radiation dose of $6.10^6$ rad is absorbed. Subsequently, the foil is contacted with an aqueous 30 percent acrylamide solution which has been heated to a temperature of 60° C for a period of 10 minutes. Thereafter, the foil is rinsed with water and treated for a period of 3 minutes in an aqueous 15 percent solution of acrylic acid at a temperature of 25° C. Subsequently, the foil is irradiated with electron beams in a homogeneous radiation field untl absorption of a radiation dose of $3.10^6$ rad.* In this manner, there is obtained a polyamide foil which can be readily dyed for decorative purposes and which is provided with an ornamental pattern.

*(electrons energy is 250 keV)

EXAMPLE 10

Figure 12:
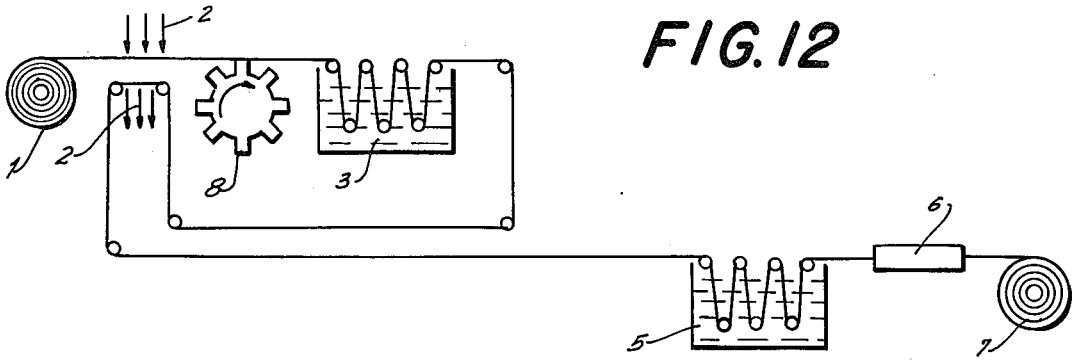

This Example describes a procedure which may be carried out with arrangements such as illustrated in FIGS. 10 and 12.

A floor covering of polyamide fibers is irradiated in the homogeneous radiation field of an electron accelerator with electrons having an energy of 1 MeV until a radiation dose of $7.10^6$ rad is absorbed. Subsequently, the radicals are destroyed locally by means of a heated, profiled roller. After the localized destruction of the radicals, the floor covering is contacted for a period of 10 minutes with an aqueous 28 percent solution of acrylic acid which has been heated to boiling temperature. Subsequently, the floor covering is squeezed by means of a pair of squeeze rolls until the weight increase of 120 percent is obtained and then again irradiated in the homogeneous radiation field of an electron accelerator, the irradiation being continued until a radiation dose of $2.10^6$ rad is absorbed. Thereafter, the floor covering is rinsed with water at a temperature of 30° C and the sodium salt of acrylic acid is then formed with sodium (Na) ions. Finally, the floor covering is dyed with a basic dyestuff. There is obtained a partially dyed, permanently dirt-repellant floor covering having good anti-static characteristics and possessing a voluminous character.

EXAMPLE 11

Figure 11:
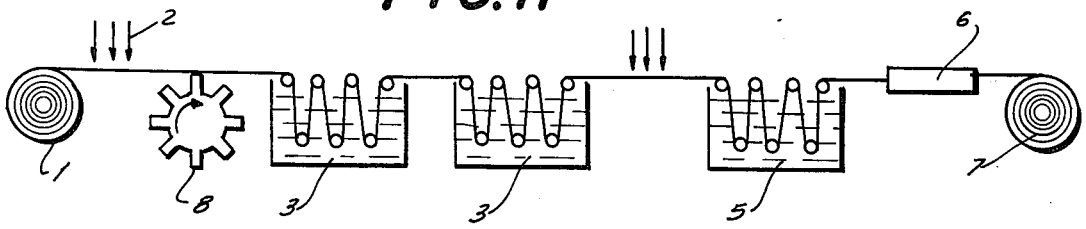

This Example describes a procedure which may be carried out with an arrangement such as illustrated in FIG. 11.

A woven fabric of polyester fibers having a mass per unit area of 160 grams per square meter is irradiated with electron beams in the homogeneous radiation field of an electron accelerator until a radiation dose of $10^7$ rad is absorbed. Subsequently, the reaction-capable species thus formed (free radicals, peroxides, hydrogen perioxide) are destroyed by means of locally acting heat using profiled rollers and the fabric contacted for a period of 15 minutes with an aqueous 12 percent solution of acrylic acid at boiling temperature. Thereafter, intensive rinsing with water is carried out at 25° C. the fabric then contacted with an aqueous 20 percent solution of acrylamide at 38° C for a period of 3 minutes and the fabric then squeezed out so that a weight increase of 100 percent is obtained. Subsequently, the fabric is irradiated in the homogeneous radiation field of an electron accelerator until a radiation dose of $2.10^6$ rad is absorbed. There is thus obtained a polyester fabric for garment textiles which can be differentially dyed, which possesses very good ability to take up water, which is dirt-repellant and which is voluminous.

EXAMPLE 12

Figure 13:
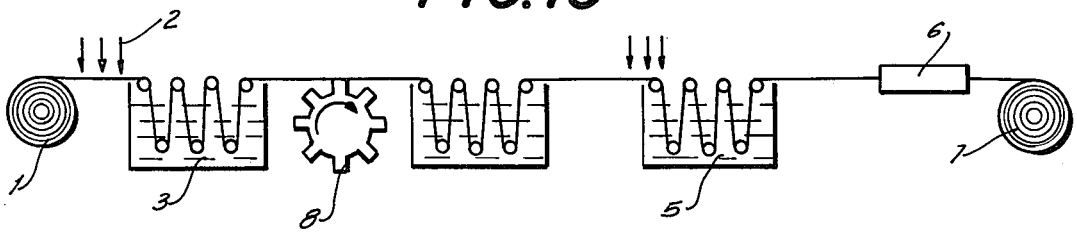

This Example describes a procedure which may be carried out with an arrangement such as illustrated in FIG. 13.

A web of flat warp knit fabric composed of polyamide silk and having a mass per unit area of 100 grams per square meter is irradiated in the homogeneous radiation field of an electron accelerator with electrons having an energy of 0.3 MeV until absorption of a radiation dose of $2.10^6$ rad. Subsequently, the web is continuously conveyed through a 15 percent solution of acrylic acid.[1]* The contact time is 10 minutes. As a result of this treatment, a homogeneous grafting of acrylic acid occurs. Thereafter, the web is contacted with a heated, profiled roller whereby free radicals still present in the web are destroyed locally. This is followed by a contact with a 12 percent solution of acrylamde for a period of 10 minutes.[2]* Since the acrylamide grafts only at those regions where the free radicals have not been destroyed by the heated, profiled roller, localized shrinkage and, concomitantly, the formation of a structure effect, occur. The structure effect is fixed by means of a subsequent irradiation in the homogeneous radiation field of an electron accelerator. Finally, the web is washed in a washing bath, dried and wound up. There is obtained a hydrophilic, structured web which possesses good anti-static characteristics and can be dyed differentially. The web is particularly well-suited as material for shirts, aprons and blouses.

[1]*(grafting temperature is 30° C)
[2]*(grafting temperature is 50° C)

EXAMPLE 13

Figure 14:
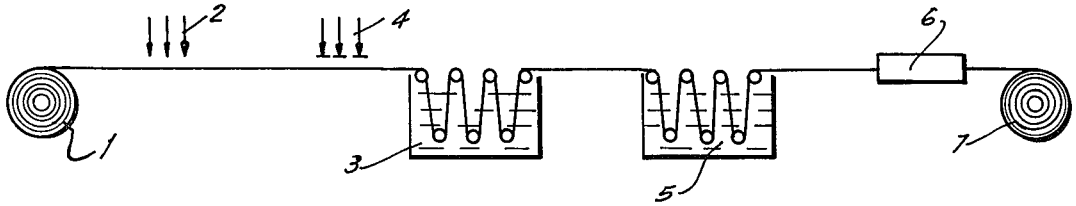

This Example describes a procedure which may be carried out with an arrangement such as illustrated in FIG. 14.

A web having a mass per unit area of 250 grams per square meter is composed of up to 50 percent polyamide fiber material and up to 50 percent polyester fiber material. The web is irradiated in the homogeneous radiation field of an electron accelerator with electrons having an energy of 0.5 MeV until a radiation dose of $2.10^6$ rad is achieved. There then follows a localized irradiation using aluminum templates having a thickness of 1 millimeter and which are provided with circular apertures having a diameter of 8 millimeters and an average distance of separation of 16 millimeters. The radiation dose achieved is $5.10^6$ rad. After the localized irradiation, contact is effected with an aqueous 20 percent solution of acrylamide having a temperature of 25° C. The contact time is 8 minutes. After washing in a washing bath, there is obtained a hydrophilic, structured web for outerwear textiles.

EXAMPLE 14

Figure 15:
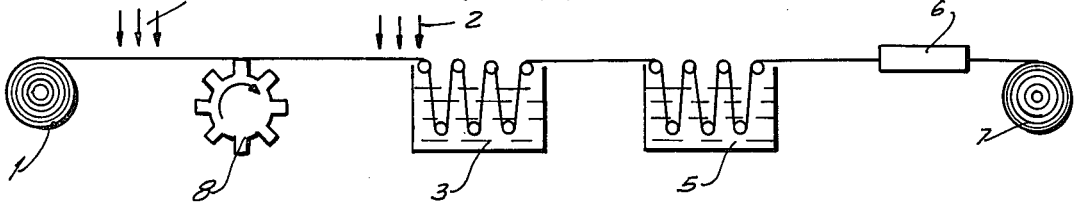

This Example describes a procedure which may be carried out with an arrangement such as illustrated in FIG. 15.

A web having a mass per unit area of 250 grams per square meter is composed of up to 50 percent polyamide fiber material and up to 50 percent polyester fiber material. The web is irradiated in the homogeneous radiation field of an electron accelerator with electrons having an energy of 0.5 MeV until a radiation dose of $5.10^6$ rad is achieved. The web is then contacted with a heated, profiled roller. There then follows an additional irradiation until a radiation dose of $2.10^6$ rad is obtained. After these treatments, contact is effected with an aqueous 20 percent solution of acrylamide having a temperature of 25° C. The contact time is 8 minutes. After washing in washing bath, there is obtained a hydrophilic, structured web for outerwear textiles.

EXAMPLE 15

A web having a mass per unit area of 250 grams per square meter is composed of up to 50 percent polyamide fiber material and up to 50 percent polyester fiber material. With the aid of aluminum templates having a thickness of 0.5 millimeters, the web is irradiated in the radiation field of an electron accelerator with electrons having an energy of 550 KeV. Since the thickness of the templates used is smaller than the maximum distance of penetration of the 550 KeV electrons, the web is both homogeneously and locally irradiated in a single irradiating operation.* After the irradiation, the web is contacted with a 20 percent acrylamide solution having a temperature of 20° C. The contact time is 8 minutes. Subsequent to washing in a washing bath, there is obtained a hydropilic, structure web for outerwear textiles.

*Radiation irradiated into the fabric is $1.10^6$ rad, where the thickness of the templates used is smaller than the maximum distance of penetration of the 550 KeV electrons. The radiation locally irradiated into the fabric is $8.10^6$ rad.

It is pointed out that the graft copolymerization obtained by means of radiation-chemical methods in the Examples can, in accordance with the invention, be achieved as well with all of the known chemical methods used heretofore for producing graft copolymerization.

It will be understood that each of the elements desribed above, or two or more together, may also find a useful application in other types of methods and arrangements differing from the types described above.

While the invention has been illustrated and described as embodied in a method for the enhancement of polymers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of enhancing the properties and appearance of polymeric substances, particularly textiles, comprising treating a surface portion of a polymer so as to effect graft polymerization over substantially the entire extent of said surface portion in such a manner that variations in graft density occur across said surface portion, whereby the properties of said surface portion are enhanced due to graft polymerization over substantially the entire extent thereof and a textured appearance is imparted to said surface portion due to said variations in graft density, the treating step comprising grafting a substance over said surface portion substantially homogeneously, and said substantially homogeneous grafting comprising substantially homogeneously irradiating said surface portion so as to cause the formation of chemically active species and substantially homogeneously contacting said surface portion with a substance which undergoes a graft polymerization reaction with said species, the treating step also comprising grafting a substance over localized regions of said surface portion only, and said localized grafting comprising substantially homogeneously irradiating said surface portion so as to cause the formation of chemically active species, eliminating the latter in the regions of said surface portion other than said localized regions and substantially homogeneously contacting said surface portion with a substance which undergoes a graft polymerization reaction with the chemically active species in said localized regions.

2. A method as defined in claim 1, wherein the irradiating step is at least in part carried out prior to the contacting step.

3. A method as defined in claim 1, wherein the irradiating step is at least in part carried out during the contacting step.

4. A method as defined in claim 1, wherein the irradiating step is at least in part carried out subsequent to the contacting step.

5. A method as defined in claim 1, wherein said surface portion is subjected to tension during at least part of the treating step.

6. A method of enhancing the properties and appearance of polymeric substances, particularly textiles, comprising treating a surface portion of a polymer so as to effect graft polymerization over substantially the entire extent of said surface portion in such a manner that variations in graft density occur across said surface portion, whereby the properties of said surface portion are enhanced due to graft polymerization over substantially the entire extent thereof and a textured appearance is imparted to said surface portion due to said variations in graft density, the treating step comprising grafting a substance over said surface portion substantially homogeneously, and the treating step also comprising grafting a substance over localized regions of said surface portion only, said localized grafting comprising substantially homogeneously irradiating said surface portion so as to cause the formation of chemically active species, eliminating said chemically active species in the regions of said surface portion other than said localized regions and substantially homogeneously contacting with surface portion with a substance which undergoes a graft polymerization reaction with said species.

7. A method as defined in claim 6, wherein said substantially homogeneous grafting is carried out prior to said localized grafting.

8. A method as defined in claim 6, wherein said substantially homogeneous grafting is carried out subsequent to said localized grafting.

9. A method as defined in claim 6, wherein the substance which is substantially homogeneously grafted over said surface portion is the same as that which is grafted over said localized regions only.

10. A method as defined in claim 6, wherein the substance which is substantially homogeneously grafted over said surface portion is different from that which is grafted over said localized regions only.

11. A method as defined in claim 6, wherein at least one of the grafting steps comprises contacting said surface portion with a liquid medium which includes the substance to be grafted over said surface portion.

12. A method as defined in claim 6, wherein at least one of the grafting steps comprises contacting said surface portion with a gaseous medium which includes the substance to be grafted over said surface portion.

13. A method as defined in claim 6, wherein the substance which is grafted over said surface portion in at least one of the grafting steps comprises a monomer.

14. A method as defined in claim 13, wherein said monomer comprises a vinyl compound.

15. A method as defined in claim 4, wherein said vinyl compound comprises a member of the group consisting of acrylic acid, acrylamide and styrene.

16. A method as defined in claim 6, wherein said surface portion is rinsed between said substantially homogeneous grafting and said localized grafting.

17. A method as defined in claim 16, wherein said surface portion is dried between said substantially homogeneous grafting and said localized grafting.

18. A method as defined in claim 6, wherein the eliminating step comprises heating said other regions.

19. A method as defined in claim 18, wherein the heating step comprises contacting said surface portion with a heated, profiled, rotating member.

20. A method as defined in claim 6, wherein the eliminating step comprises subjecting said other regions to the action of a laser beam.

21. A method as defined in claim 6, wherein said surface portion is subjected to tension during at least one of the grafting steps.

22. A method of enhancing the properties and appearance of polymeric substances, particularly textiles, comprising treating a surface portion of a polymer so as to effect graft polymerization over substantially the entire extent of said surface portion in such a manner that variations in graft density occur across said surface portion, whereby the properties of said surface portion are enhanced due to graft polymerization over substantially the entire extent thereof and a textured appearance is imparted to said surface portion due to said variations in graft density, the treating step comprising forming chemically active species at substantially every point of said surface portion in such a manner that the concentration of said chemically active species varies across said surface portion, and only once contacting said surface portion with a substance which undergoes a graft polymerization reaction with said species so that graft polymerization over substantially the entire extent of said surface portion is obtained substantially simultaneously with variations in graft density across said surface portion.

23. A method as defined in claim 22, wherein the forming step comprises directing a radiation beam at said surface portion and varying the intensity of said beam.

24. A method as defined in claim 22, wherein the forming step comprises irradiating at least part of said surface portion with electrons.

25. A method as defined in claim 24, wherein at least some of said electrons have an energy between about 40 KeV and 3 MeV.

26. A method of enhancing the properties and appearance of polymeric substances, particularly textiles, comprising treating a surface portion of a polymer so as to effect graft polymerization over substantially the entire extent of said surface portion in such a manner that variations in graft density occur across said surface portion, whereby the properties of said surface portion are enhanced due to graft polymerization over substantially the entire extent thereof and a textured appearance is imparted to said surface portion due to said variations in graft density, the treating step comprising forming chemically active species in varying concentration across said surface portion and at least once contacting said surface portion with a substance which undergoes a graft polymerization reaction with said species, and the forming step comprising irradiating said surface portion by directing a beam of radiation at said surface portion and at least partially shielding selected regions of said surface portion from said radiation beam, the shielding step comprising interposing between the radiation source and said surface portion a perforate member having a thickness less than the maximum distance which said radiation can penetrate into said member.

27. A method as defined in claim 26, wherein the contacting step comprises contacting said surface portion with a liquid medium which includes said substance.

28. A method as defined in claim 26, wherein the contacting step comprises contacting said surface portion with a gaseous medium which includes said substance.

29. A method as defined in claim 26, wherein said substance comprises a monomer.

30. A method as defined in claim 29, wherein said monomer comprises a vinyl compound.

31. A method as defined in claim 30, wherein said monomer comprises a member of the group consisting of acrylic acid, acrylamide and styrene.

32. A method of enhancing the properties and appearance of polymeric substances, particularly textiles, comprising treating a surface portion of a polymer so as to effect graft polymerization over substantially the entire extent of said surface portion in such a manner that variations in graft density occur across said surface portion, whereby the properties of said surface portion are enhanced due to graft polymerization over substantially the entire extent thereof and a textured appearance is imparted to said surface portion due to said variations in graft density, the treating step comprising forming chemically active species in varying concentration across said surface portion and at least once contacting said surface portion with a substance which undergoes a graft polymerization reaction with said species, and the forming step comprising irradiating said surface portion and eliminating at least some of said chemically active species at selected regions of said surface portion.

33. A method as defined in claim 32, wherein the irradiating step comprises directing a beam of radiation at said surface portion and shielding the regions of said surface portion other than said localized regions from the radiation.

34. A method as defined in claim 32, wherein the irradiating step comprises directing a radiation beam at said surface portion and controlling the direction of said radiation beam so that only said localized regions are irradiated.

35. A method as defined in claim 32, wherein the irradiating step comprises directing a radiation beam at said surface portion and varying the intensity of said radiation beam.

36. A method as defined in claim 32, wherein the irradiating step comprises directing a radiation beam at said surface portion, controlling the direction of said radiation beam so that only said localized regions are irradiated and varying the intensity of said radiation beam.

37. A method as defined in claim 32, wherein th eliminating step comprises heating said selected regions.

38. A method as defined in claim 37, wherein the heating step is carried out such that only some of said chemically active species are eliminated at said selected regions.

39. A method as defined in claim 37, wherein the heating step is carried out such that substantially all of said chemically active species are eliminated at said selected regions.

40. A method as defined in claim 37, wherein the heating step comprises contacting said surface portion with a heated, profiled, rotating member.

41. A method as defined in claim 32, wherein the eliminating step comprises subjecting said selected regions to the action of a laser beam.

42. A method as defined in claim 32, wherein the forming step comprises directing a beam of radiation at said surface portion and controlling the direction of said beam so that only localized regions of said surface portion are irradiated.

43. A method as defined in claim 42, wherein the intensity of said beam is varied.

* * * * *